United States Patent [19]

Fitzgerald

[11] 4,152,622

[45] May 1, 1979

[54] LAMP-BASE ASSEMBLY

[75] Inventor: James J. Fitzgerald, Kinnelon, N.J.

[73] Assignee: Wagner Electric Corporation, Parsippany, N.J.

[21] Appl. No.: 809,556

[22] Filed: Jun. 24, 1977

[51] Int. Cl.[2] ..... H01K 1/42; H01K 1/44

[52] U.S. Cl. ..... 313/318; 313/315; 339/17 D; 339/127 R; 362/95; 362/382; 362/429; 362/457

[58] Field of Search ..... 362/95, 429, 457, 382; 339/17 D, 74 L, 127 R; 313/51, 318

[56] References Cited

U.S. PATENT DOCUMENTS

| | | | |
|---|---|---|---|
| 2,757,349 | 7/1956 | Erbal | 339/17 D X |
| 2,892,992 | 6/1959 | Grovemiller et al. | 339/17 D X |
| 3,286,218 | 11/1966 | Wright et al. | 313/318 UX |
| 3,511,982 | 5/1970 | Salter | 362/95 X |
| 3,555,341 | 1/1971 | Curtis | 313/318 |

*Primary Examiner*—Richard D. Lovering

*Attorney, Agent, or Firm*—Eyre, Mann, Lucas & Just

[57] ABSTRACT

A baseless light bulb is locked into a one-piece molded base and the base provides mechanical and electrical connection of the light bulb to a circuit board.

10 Claims, 2 Drawing Figures

FIG. 1
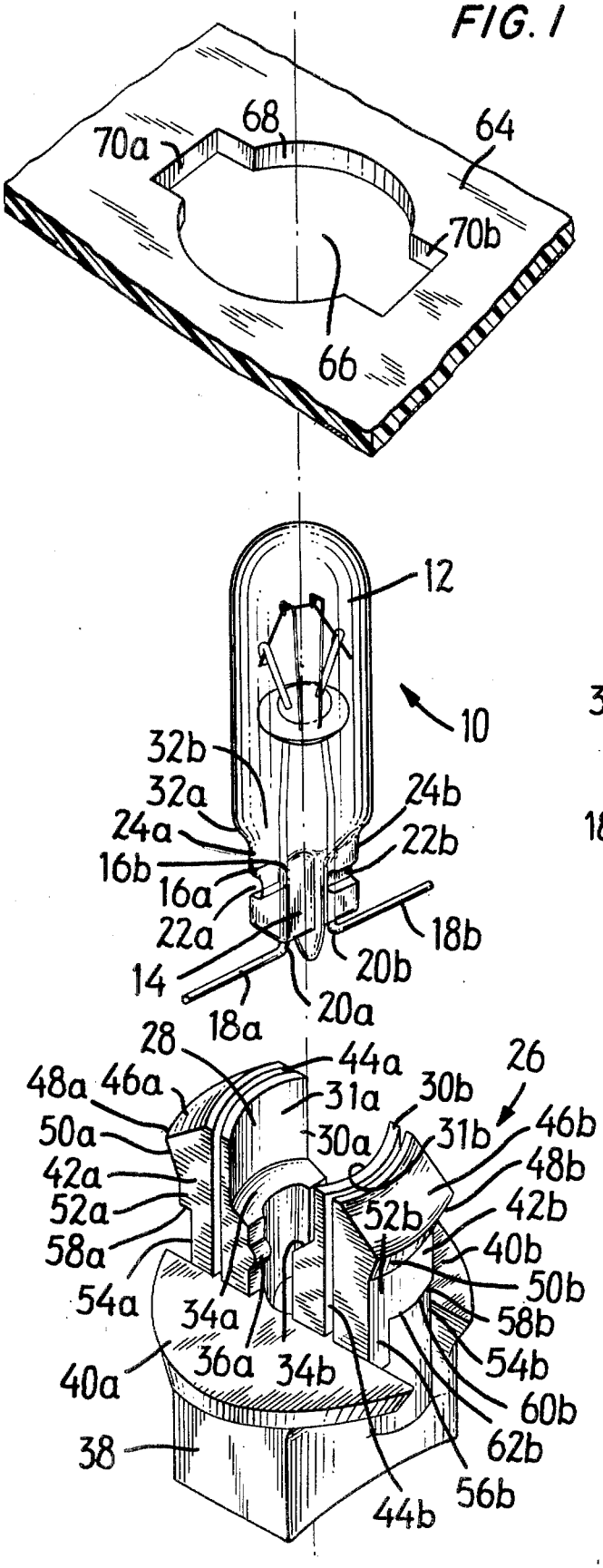
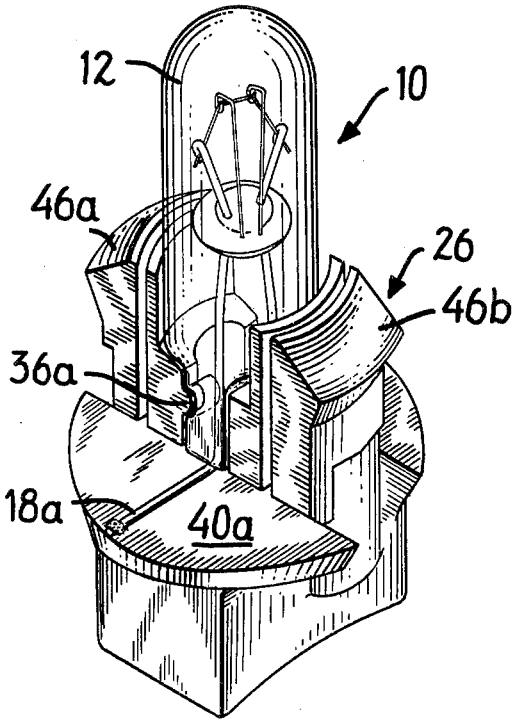
FIG. 2

LAMP-BASE ASSEMBLY

BACKGROUND OF THE INVENTION

Electric filament-type lamps are customarily manufactured by first fabricating the glass envelope having filaments sealed within and conductors passing through the glass, and then assembling the glass envelope into a base and making electrical connection to contact members. For use in circuit boards, the lamp base has means for attaching the lamp to the circuit board and of camming the contact members into contact with conductive areas on the circuit board. Examples of these types of lamp bases are disclosed in U.S. Pat. Nos. 3,403,370; 3,447,016; and 3,555,341. The requirement for assembling to contact members adds to the cost as well as contributing to intermittent electrical contact.

BRIEF DESCRIPTION OF THE DRAWINGS

FIG. 1 shows an exploded perspective view of the components comprising the invention aligned with a mounting hole in a circuit board.

FIG. 2 shows a lamp assembled into its base.

DETAILED DESCRIPTION OF THE PREFERRED EMBODIMENT

Referring to FIG. 1, an unbased lamp, shown generally at 10, has an upper envelope 12 which may contain filaments or other light-generating elements (not shown) and a lower body 14. In the embodiment shown, the lower body 14 has substantially parallel sides 16*a*, 16*b* but may terminate at the base of the upper envelope. Electrical conductors 18*a*, 18*b* extend from the lower body 14 and are bent at 20*a*, 20*b* to place the axis of the extremities of the conductors 18*a*, 18*b* at approximately right angles to the axis of the lamp 10. Two notches 22*a* and 22*b* are molded into the lower body 14 during fabrication of the lamp 10. Each notch 22*a* or 22*b* forms a concave depression in the lower body 14. The two notches 22*a* and 22*b* are located adjacent to opposite lateral edges 24*a*, 24*b* of the lower body 14 and extend less than half way across the lower body 14. As will be clear to one skilled in the art in the light of this disclosure, the exact number and shape of the notches 22*a*, 22*b* could be changed without departing from the spirit of this invention.

A one-piece molded base, especially adapted for use with the lamp 10 above described is shown generally at 26. As indicated by the dashed line passing along the axes of the lamp 10 and the base 26, the lamp 10 fits into the molded cavity 28 in the base 26 formed by two semi-cylindrical leaves 30*a*, 30*b*. The approximately cylindrical upper envelope 12 nests in the cylindrical sector inner surfaces 31*a*, 31*b* of the leaves 30*a*, 30*b*. The boss 36*a* fits tightly against the side 16*a* of the lower body 14 during insertion of the lamp 10 and snaps into notch 22*a*. A second boss 36*b* on semi-cylindrical leaf 30*b*, hidden by other parts, snaps into notch 22*b*. The engagement of the bosses 36*a*, 36*b* in grooves 22*a*, 22*b* mechanically retain the lamp 10 in the base 26 against both axial and lateral displacement. Other means for retaining the lamp in the base such as adhesive, either cement or solvent which tackifies the material of the base, may be used to retain the lamp in the base. Furthermore, the lamp may be arranged in the base to be visible on either side of the circuit board without departing from the invention.

The base 26 has a lower body 38 which is advantageously formed with a rectangular or other shape which facilitates manual handling and provides a finger grip for twisting the base 26 into place on the circuit board as will be described. The lower body 38 terminates in two semi-circular plane surfaces 40*a*, 40*b*. The plane surfaces 40*a*, 40*b* are substantially co-planar and their plane is normal to the axis indicated by the dashed line. As best seen in FIG. 2, when thus assembled, the conductors 18*a*, 18*b* lie upon the surfaces 40*a*, 40*b*. The conductors 18*a*, 18*b* may be affixed to the base 26 for example by adhesive means or heat sealing near the places where the conductors 18*a*, 18*b* approach the outer edges of the surfaces 40*a*, 40*b*, or alternatively the conductors 18*a*, 18*b* may be left unaffixed. The adhesive means may be electrically conductive. A shallow groove having a depth less than the diameter of the conductors 18*a*, 18*b* may be provided in the surfaces 40*a*, 40*b* to retain the conductors 18*a*, 18*b* against twisting during insertion.

Two outer semi-cylindrical leaves 42*a*, 42*b* are spaced away from the inner semi-cylindrical leaves 30*a*, 30*b* leaving annular relief spaces 44*a*, 44*b* between them. The upper portions of the outer semi-cylindrical leaves 42*a*, 42*b* are portions of a frusto-conal surface 46*a*, 46*b*. The frusto-conal surfaces 46*a*, 46*b* end in a lip 48*a*, 48*b*. Below the lips 48*a*, 48*b*, frusto-conal wedge surfaces 50*a*, 50*b* converge toward the axis and terminating in stem portions 52*a*, 52*b*. The stem portions 52*a*, 52*b* are partially undercut by mounting grooves 54*a*, 54*b* extending tangentially from the counterclockwise edge of the stem portions 52*a*, 52*b* as seen from above and terminating in a stop bar 56*a*, 56*b* (56*a* is hidden). The mounting grooves 54*a*, 54*b* have camming surfaces 58*a*, 58*b* which overlay the front surface of a circuit board as will be explained. The camming surfaces 58*a*, 58*b* having leading portions 60*a* (hidden) and 60*b*. The planes of the leading portions 60*a*, 60*b* are inclined to the axis in order to pull the base tightly into contact with the circuit board during insertion. The trailing portions 62*a*, 62*b* are more normal to the axis to securely hold the base against the circuit board 64. The circuit board 64 shown fragmentarily at the top of the exploded view has a hole 66 adapted to the insertion and locking of the based lamp. The hole 66 has a central generally circular portion 68 and two wings 70*a*, 70*b*. The base 26 with attached lamp 10 is inserted through the rear of the hole 66 with the inner semi-cylindrical leaves 30*a*, 30*b* and the outer semi-cylindrical leaves 42*a*, 42*b* passing through the wings 70*a*, 70*b* until the surfaces 40*a*, 40*b* come into contact with the rear of the circuit board 64. This brings the conductors 18*a*, 18*b* into contact with metallic regions on the rear of the circuit board 64 through which electrical power may be fed.

To lock the lamp 10 and base 26 into the circuit board 64 the base is rotated clockwise, as seen from the bottom. As the base 26 begins to rotate, the inclined leading portions 60*a*, 60*b* are brought atop the circuit board adjacent to the circular portion 68 of the hole 66. With further rotation, the inclined leading portions 60*a*, 60*b* tend to bear the lamp base 26 more tightly against the circuit board 64. The relief spaces 44*a*, 44*b* allow the outer semi-cylindrical leaves 42*a*, 42*b* to deflect inward somewhat to produce a tight fit of the base 26 against the circuit board 64. Upon continued rotation, the trailing portions 62*a*, 62*b* of the camming surfaces 58*a*, 58*b* bear against the circuit board 64 and hold the base 26 firmly in place. Further rotation of the base 26 is stopped when the stop bars 56*a*, 56*b* (56*a* is hidden) contact the sides of the wings 70*a*, 70*b*. In attaining the condition just described, the lamp 10 and base 26 are fully installed with power being connected through conductive areas on the circuit board to the conductors 18*a*, 18*b* tightly held in contact with the back of the circuit board.

It will be understood that the claims are intended to cover all changes and modifications of the preferred embodiments of the invention, herein chosen for the purpose of illustration which do not constitute departures from the spirit and scope of the invention.

What is claimed is:

1. A lamp having a glass envelope with first and second electrical leads passing sealably therethrough and a base therefor for mounting in a shaped hole in a circuit board comprising:

(a) said base being of electrically insulating material;

(b) means for retaining said lamp in said base;

(c) said base having at least one portion for projecting through said shaped hole and at least one camming means adapted to applying holding force to a first surface of said circuit board;

(d) first and second surface areas on said base adapted to be drawn toward a second surface of said circuit board by said holding force when assembled;

(e) said first electrical lead being disposed at said first surface area in a position where it will be pressed between said first surface area and said circuit board when installed;

(f) said second electrical lead being disposed at said second surface area in a position where it will be pressed between said surface area and said circuit board when installed; and (g) said at least one portion for projecting through comprises:

(i) two facing cylindrical sectors symmetrically disposed;

(ii) said cylindrical sectors being fittable through said shaped hole in at least one angular relationship therewith; and (iii) annular segment relief spaces inwardly adjacent said cylindrical sectors whereby said cylindrical sectors are permitted to deflect inward during installation in said circuit board.

2. The apparatus recited in claim 1, wherein said means for retaining comprises:

(a) said lamp having a generally flat lower body having first and second sides;

(b) said lamp having an envelope which is larger in at least one dimension than said lower body;

(c) inner surfaces on said base for engaging at least said lower body; and (d) at least one notch and at least one boss for holding engagement between said base and said lower body.

3. The apparatus recited in claim 2 further comprising other inner surfaces on said base for guiding and supporting engagement with a peripheral portion of said envelope.

4. The apparatus recited in claim 1 further comprising means for securing said first and second electrical leads against said first and second surface areas respectively.

5. The apparatus recited in claim 5 further comprising:

(a) said at least one camming means being a tangential undercut in the outer surface of at least one of said cylindrical sectors;

(b) at least part of the surface adjacent to said undercut being inclined to said circuit board; and (c) and the surface adjacent to said undercut being adapted to overlap the perimeter of said shaped hole upon rotation of said base during installation.

6. The apparatus recited in claim 5 wherein said tangential undercut terminating in a stop bar, said stop bar being adapted to abut an interfering surface in said shaped hole whereby the maximum rotation of said base is limited to a predetermined amount.

7. The apparatus recited in claim 1 further comprising the axial extremities of said two facing cylindrical sectors being frusto-conal sectors.

8. The apparatus recited in claim 1 wherein said means for retaining is adhesive.

9. The apparatus recited in claim 8 wherein said adhesive is electrically conductive.

10. The apparatus recited in claim 1 wherein said means for retaining comprises means for providing mechanical retention of said glass envelope in said base.

* * * * *